US005253441A

United States Patent [19]

Rachiele et al.

[11] Patent Number: 5,253,441

[45] Date of Patent: Oct. 19, 1993

[54] DEVICE FOR LISTING AND MARKING ITEMS AND ERRANDS

[75] Inventors: Fred Rachiele, 1 Automatic Road, Brampton, Ontario, L6S 4K6; Ray Anderson, Vancouver, both of Canada

[73] Assignee: Fred Rachiele, Ontario, Canada

[21] Appl. No.: 878,077

[22] Filed: May 4, 1992

[51] Int. Cl.[5] ..... G09F 7/00

[52] U.S. Cl. ..... 40/488; 40/491; 116/324

[58] Field of Search ..... 40/375, 486, 488, 490, 40/491; 116/321, 322, 323, 324

[56] References Cited

U.S. PATENT DOCUMENTS

| | | | |
|---|---|---|---|
| 1,717,048 | 6/1929 | Livingston | 116/323 |
| 2,695,000 | 11/1954 | Farkas et al. | 116/324 |
| 3,485,204 | 12/1969 | Christman | 116/324 |
| 3,913,249 | 10/1975 | Kaslow | 116/323 X |

*Primary Examiner*—Kenneth J. Dorner

*Assistant Examiner*—Brian K. Green

[57] ABSTRACT

A listing device is disclosed for recording domestic household items which must be purchased on an ongoing basis and for indicating chores and appointments which must be regularly observed. The listing device includes a planar support sheet and plate displaying an itemized shopping list attached to the sheet. The itemized shopping list comprises items arranged sequentially in two vertical columns. The sheet is attached to one side of a backing. Another support sheet and plate with itemized shopping list may be attached to the other side of the backing and several backings can be retained in a hand-held binder or booklet. A visual indicator, such as a bright color patch is located adjacent to each visually discernable item on the list. A cover tab for covering the color patches are included and are movable between a covering position in which the color patch is covered and an uncovering position in which the visual indicator is uncovered thereby drawing the user's attention to that particular item on the list. The cover tab can be locked in the covered or uncovered position.

5 Claims, 3 Drawing Sheets

DEVICE FOR LISTING AND MARKING ITEMS AND ERRANDS

FIELD OF THE INVENTION

The present invention relates to a device for presenting a list of items and for marking items in the list. The invention has utility in recording a need for obtaining groceries and performing domestic chores.

BACKGROUND OF THE INVENTION

The day-to-day business of running a family is both time consuming and ongoing. The current prevailing economic and social conditions in North America dictate that in many families both spouses must work which limits the time either can spend on domestic chores. The situation is even more acute in single parent families where in addition to a full days work the parent must also see to the household needs.

One particularly time consuming domestic activity which requires attending to on a regular basis is grocery shopping. At present, the practise in most households is to compile a written shopping list prior to departing on the shopping excursion. A drawback to this procedure is that when the shopping list is compiled in one sitting, items may be inadvertently left off the list due to forgetfulness thereby leading to multiple shopping trips resulting in wasted time and added expense. In other procedures, items are added to a master shopping list on an ongoing basis as the need for them is realized. A drawback to this procedure is that such lists are prone to being misplaced or lost.

Accordingly, it would be advantageous to provide a permanent, reusable and dedicated listing device which provides a fast and convenient means of signalling the shopper which grocery, household or other items are required.

A device for presenting a list of items and for marking items in the list is provided. The device comprises a plate having indicia on one side thereof and indicator means located in adjacent relation to the indicia on the plate. A plurality of slidable tab means for selectively covering the adjacent indicator means is provided. Each tab means has a cover tab and a pair of resilient legs. Provided is a support member having a plurality of spaced, parallel guide channels with the pair of resilient legs of the slidable tab means being located in the parallel guide channels. Each of the slidable tab means being slidably movable between a covering position in which the cover tab is substantially covering the indicator means and an uncovering position in which the portion of the indicator means is not covered by the cover tab. The device includes locking means for locking the tab means in the covering or uncovering positions, wherein the locking means for each of the plurality of guide channels and the associated tab means comprises a pair of boss members providing into the guide channel from opposed guide channel walls and an indentation located on a surface of each of the pair of resilient legs of the elongate portion adjacent to the side walls of the guide channel. The indentations are for receiving therein a boss member in order to lock the tab means in the covering or uncovering position.

BRIEF DESCRIPTION OF THE DRAWINGS

Various embodiments of the listing device forming the subject invention will now be described, by way of example only, reference being had to the accompanying drawings, in which.

DETAILED DESCRIPTION OF THE INVENTION

Figure 1:
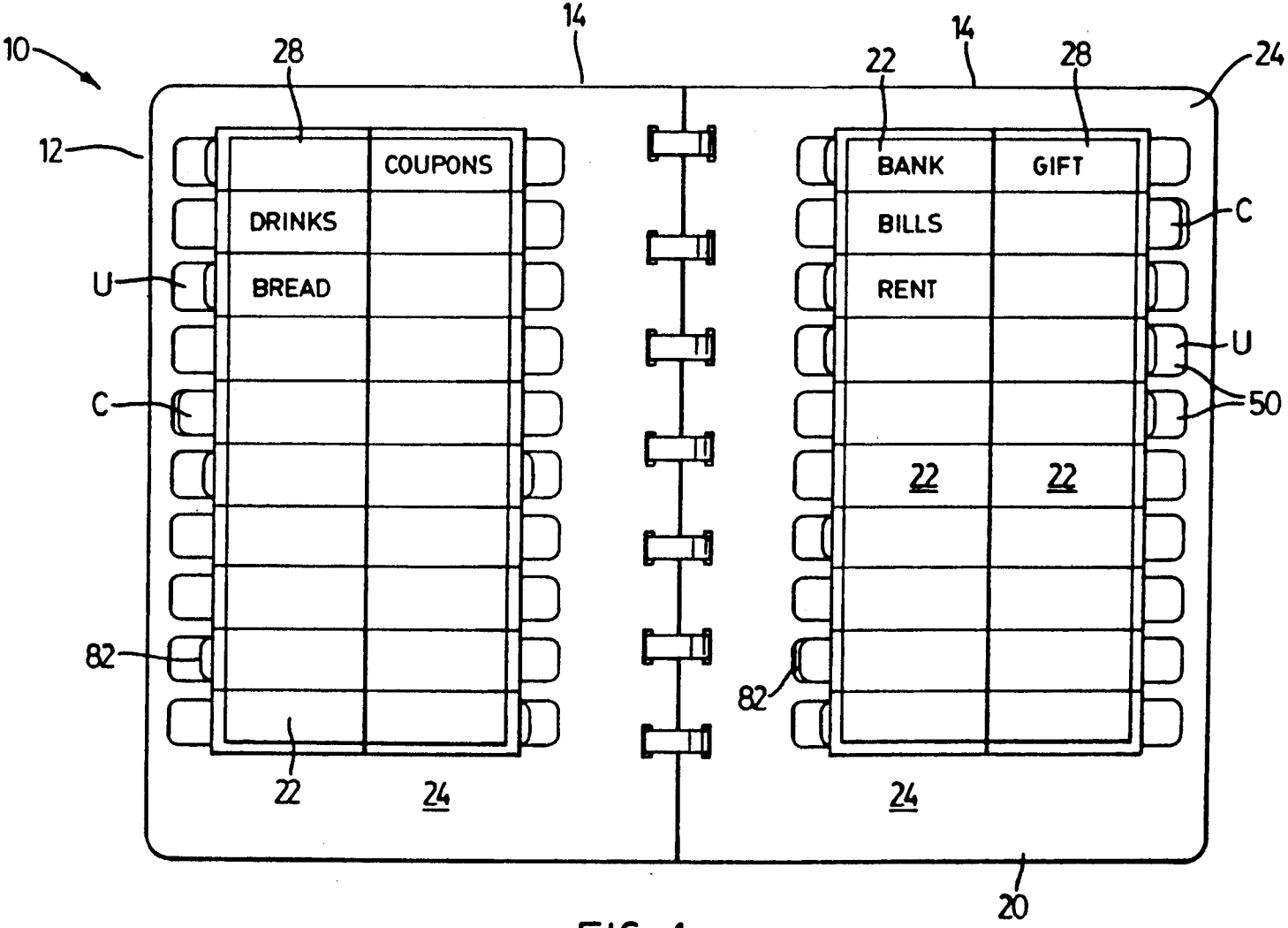
FIG. 1 is a plan view of a listing device in a booklet format.
Figure 2:
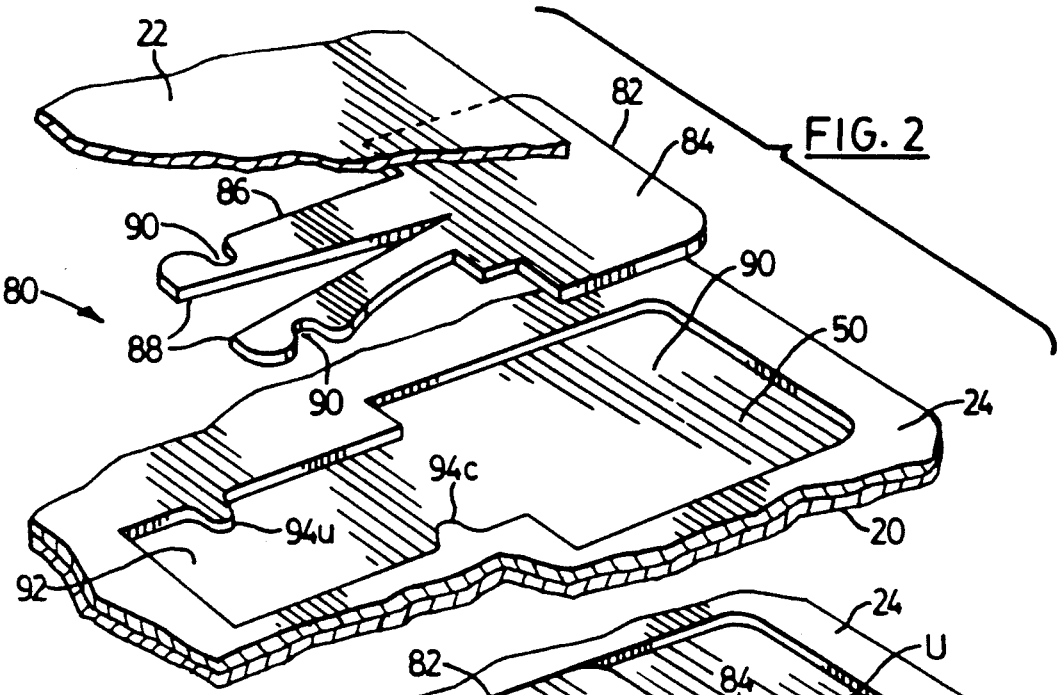
FIG. 2 is an exploded view of an embodiment of over tab mechanism made in accordance with the present invention.
Figure 3:
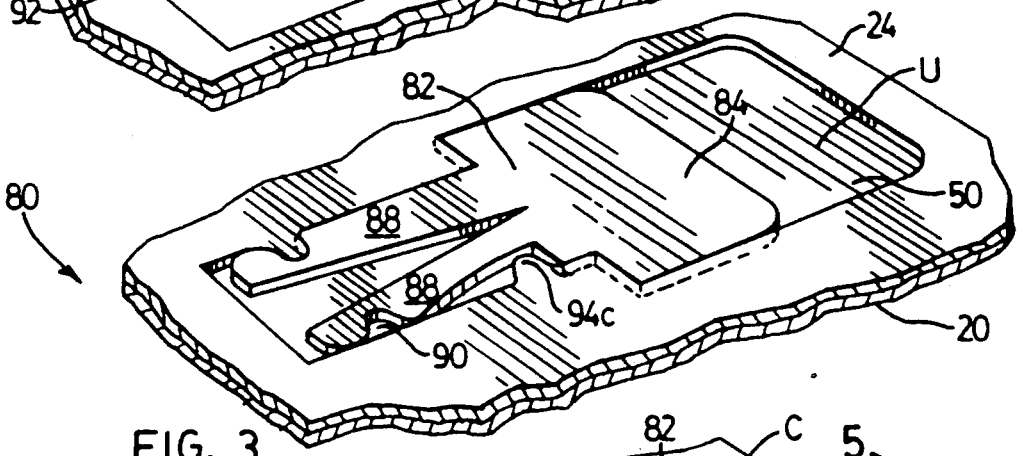
FIG. 3 is a perspective view of the assembled cover tab mechanism of FIG. 2 with the cover tab in the uncovered position.

In the ensuing description of the structure and operation of the listing device forming the subject invention, reference will be made to the drawings in which like numerals refer to like parts. Referring to FIG. 1, a permanent shopping list device 10 includes a multi-ring binder 12 having a plurality of leafs 14 receivable in the binder. Leafs 14 comprise a planar supporting member or backing 20 which may be fabricated of rigid cardboard or plastic. Mounted on support backing 20 is a rigid sheet 24 which has a list marking merchandising 80, as will be described hereinafter. A permanent shopping list is provided by two columns of indicia printed on rigid cardboard plates 22; plates 22 are mounted on sheet 24. A sheet 24 and plates 22 may be provided on both sides of backing 20 so that shopping lists are provided on both sides of the support 20. A protective plastic cover sheet 28 may overlay the lists on plate 22. The lists of domestic items shown on plates 22 may be grocery items typically required on an ongoing basis or alternatively they may refer to other items such as tasks which must be performed or appointments to be kept. Located on the outer edges of the shopping lists and adjacent each item on the shopping list is a movably mounted tab member 82 which forms part of the list marking mechanism. Tab member 82 is movably mounted between support 20 and plate 22 in sheet 24 in a manner to be presently described and can be moved between a first covering position C and a second uncovering position U in which a distinctive indicator area 50 is clearly visible thereby visually indicating the adjacent item on the shopping list to the user. Alternatively, the indicia may be brail indicia so that when uncovered a blind user may be alerted to the uncovered indicia.

Figure 4:
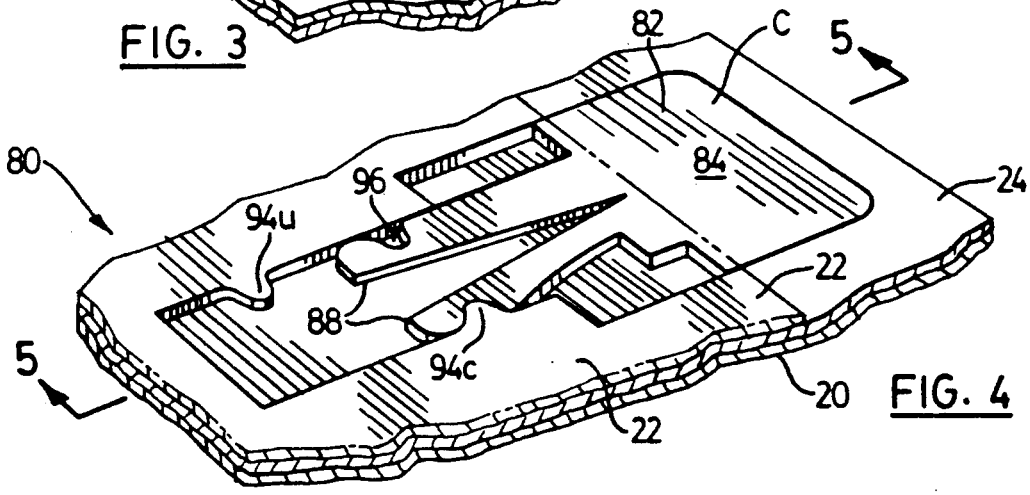
FIG. 4 is a perspective view similar to FIG. 3 but with the cover tab in the covering position.
Figure 5:
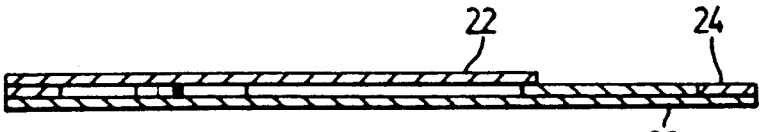
FIG. 5 is a sectional side view taken along the line 5—5 of FIG. 4.

Referring to FIGS. 2 to 5, there is shown generally at 80 the list marking mechanism comprising the tab member 82 illustrated in FIG. 1. The tab member 82 has a cover tab 84 and an elongate portion 86. Portion 86 includes two divergent, resilient legs 88 depending from cover tab 84, each leg being provided with an indent 90 located proximate its free end. Sheet 24 is provided with a plurality of elongate guide channels 92 which are of a complementary shape to receive tab member 82. The guide channels 92 of sheet 24 are each provided with a pair of spaced, inwardly protruding boss members **94*c*, 94*u*; boss 94*u* is adapted to be received by an indent 90 in one leg 88** when the tab member is in the uncovering position U shown in FIG. 3. FIG. 4 shows tab member 82 locked in the covering position C wherein the indent 90 in the other leg is engaged by the other boss member 94c. Bosses 94c, 94u and legs 88 form a locking means to lock tab member 82 in either position. Tab member 82 may be provided with a raised portion located along the outer peripheral edge of cover plate (not shown). To expose indicator area 50, tab member 82 is pushed inwardly so that the leg 88 engaged with boss 94 pops free and, when area 50 has been uncovered, the other leg 88 is engaged by the other boss 94 popping into the appropriate indent 90 to positively lock tab member 82 in the uncovering position. To cover marker area 50 the reverse procedure is followed.

Figure 6:
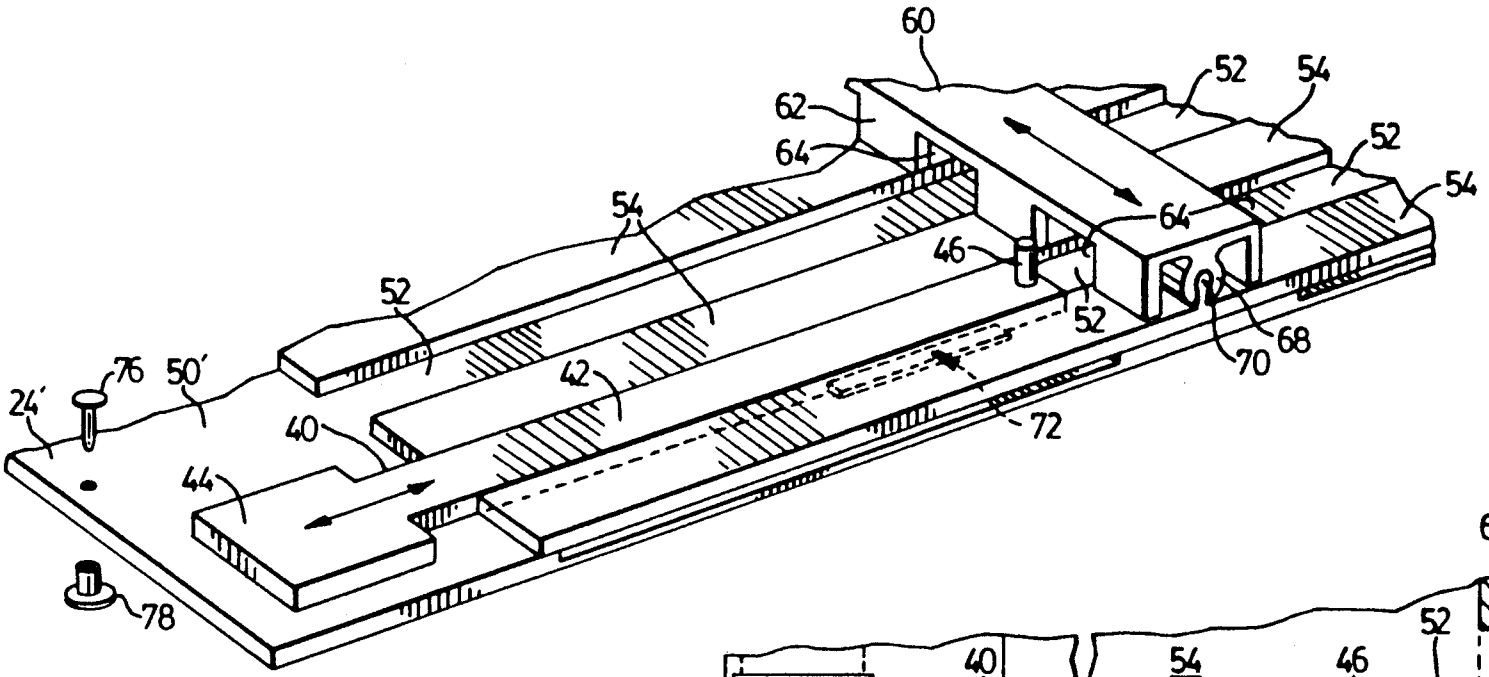
FIG. 6 is a perspective view, broken away, of another embodiment of a cover tab mechanism forming part of the subject invention.
Figure 7:
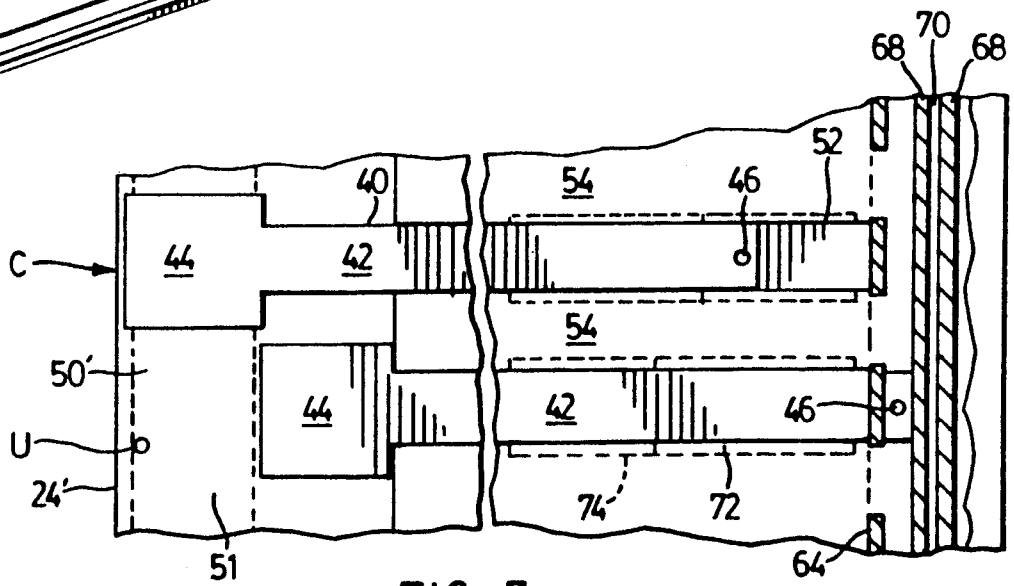
FIG. 7 is a partially sectioned plan view of the cover tab mechanism of FIG. 6.

Referring now to FIGS. 6 and 7, another embodiment of the listing device is shown and illustrates a portion of the device separated from its backing support and minus cardboard plates with columns of indicia in order to illustrate the movable tab mechanism. A cover tab member 40 includes an elongate, central shank portion 42 having wings 72, a cover tab 44 formed at one end of shank 42 and a locking member comprising pin 46 attached to the other end of shank 48. Tab member 40 can be moved between a first covering position C and a second uncovering position U in which distinctive indicator area 50' is clearly visible thereby visually indicating that the adjacent item on the shopping list must be purchased. Sheet 24' is provided with a plurality of horizontal guide channels 52 which may be formed by a plurality of strips 54 supported on the sheet in spaced vertical relationship. Strips 54 have slot forming undercuts 74, for reasons which will become apparent hereinafter. Guide channels 52 terminate at a position which is inwardly spaced from marker area 50' and are located under the plates of indicia when these are secured to sheet 24'. Cover plate 44 is wider than guide channel 52 so that tab member 40 can slide between the covering position C in which indicator area 50' is substantially covered and the uncovered position U in which the edges of cover plate 44 adjacent shank 42 abut the ends of strips 54 thereby exposing indicator area 50'. Area 50' may be provided by a bright red stripe extending along and spaced inwardly from the edge of backing plate 24' as shown in the region 51 bounded by the broken lines in FIG. 7.

A tab locking bar 60 is slidably mounted on sheet 24' between two plates 22 of indicia (not shown). Bar 60 is movable on sheet 24' in a transverse direction with respect to guide channels 52 between a locking and unlocking position. Locking bar 60 includes a generally E-shaped, elongate bracket 62 having a plurality of opposed pairs of cut-outs 64 in opposed side walls 66 along the length of bracket 62. Extending along the interior of bracket 62 is a central elongate guide channel 68 which receives therein an elongate guide member 70 projecting from sheet 24'. In the unlocked position, bar 60 is positioned as shown in FIG. 6 with cut-outs 64 positioned over channels 52. In this position tab members 40 can slide between the covering and uncovering positions. The pins 46 are of a suitable size so that they can move through cut-outs 64 as tab member 40 is slid between the closed and open position. To lock the tab member 40 in either the open or closed position, bar 60 is moved until cut-out portions 64 are located over strips 54 wherein pins 46 are locked either inside lever 60 or located on the outside thereof. Tab member 40 and bar 60 may be suitably dimensioned so that when the tab member is locked on the inside of bar 60, indicator patch 50' is clearly visible and when located on the outside of bar 60 patch 50' is completely covered. The outward movement of tab member 40 is arrested by wings 72 of shank 42 abutting the ends of undercuts 74 in the side edges of strips 54. Two sheets 24' shown in FIG. 6 may be secured one on each side of backing (not shown) using connectors 76 and 78 shown in FIG. 6. Two plates of indicia may be secured to each sheet 24' on either side of bar 60 and the entire unit releasably mounted in a binder or booklet arrangement.

In operation, to expose an indicator area 50' adjacent an item on the list to thereby signify the need for the item, bar 60 is moved in the transverse direction to an unlock position so that cut-outs 64 are accessible to pins 46. A tab member 40 is then moved inwardly until the pin 46 is positioned within bar 60. To lock pin 46 within bar 60, the latter is moved until cut-outs 64 are no longer aligned over channels 52. In this way, any item on the list may be permanently exposed at any time during the week as the need for the item becomes apparent. When the time for shopping arrives, all items required will be exposed and therefore the user will not be required to rely on memory alone to compile the shopping list at one sitting.

In addition to the permanent item list, there may be included an area for written information. Further, a pouch or several pouches may be included for storing coupons and the like within the booklet.

Also, the plates of indicia could be replaced by a pouch having a transparent outside face, the pouch for holding a sheet containing a list thereon.

While the listing device forming the subject invention has been described and illustrated with respect to various embodiments, it will be appreciated that numerous variations of these embodiments may be made without departing from the scope of the invention defined herein.

What is claimed is:

1. A device for presenting a list of items and for marking items in the list, comprising:

a) a plate having indicia on one side thereof;

b) indicator means located in adjacent relation to said indicia on said plate;

c) a plurality of slidable tab means for selectively covering said adjacent indicator means, each tab means having a cover tab and a pair of resilient legs;

d) a support member having a plurality of spaced, parallel guide channels, the pair of resilient legs of the slidable tab means being located in said parallel guide channels, each said slidable tab means being slidably movable between a covering position in which said cover tab is substantially covering said indicator means and an uncovering position in which said portion of said indicator means is not covered by said cover tab; and e) locking means for locking said tab means in the covering or uncovering positions, wherein the locking means for each of said plurality of guide channels and the associated tab means comprises a pair of boss members protruding into the guide channel from opposed guide channel walls and an indentation located on a surface of each of said pair of resilient legs adjacent to the guide channel walls of said guide channel, the indentations for receiving therein a boss member in order to lock the tab means in the covering or uncovering position.

2. A listing device according to claim 1 wherein said plurality of guide channels are located substantially below said indicia, with said indicator means being located adjacent one end of said plurality of guide channels, the resilient legs of each cover tab means being slidably movable in the guide channels between said covering position in which a portion of said indicator means is covered by said cover tab and said uncovering position in which a portion of said indicator means is not covered by said cover tab.

3. A listing device according to claim 1 wherein said indicia are visually discernable and arranged in vertical columns, the indicator means being a visual indication means.

4. A listing device according to claim 3 wherein the listing device is a first listing device, and including a plurality of listing device releasably attached together.

5. A listing device according to claim 4 wherein said visually discernable indicia comprise names of various domestic products required on an ongoing basis by a household.

* * * * *